US012736226B2

(12) United States Patent
Zhou et al.

(10) Patent No.: US 12,736,226 B2
(45) Date of Patent: Sep. 15, 2026

(54) DOOR ASSEMBLY FOR A COOKING APPARATUS

(71) Applicant: SHENZHEN CHENBEI TECHNOLOGY CO., LTD., Shenzhen (CN)

(72) Inventors: Changlong Zhou, Shenzhen (CN); Xuanyu Li, Shenzhen (CN)

(73) Assignee: Shenzhen Chenbei Technology Co., Ltd., Shenzhen (CN)

( * ) Notice: Subject to any disclaimer, the term of this patent is extended or adjusted under 35 U.S.C. 154(b) by 340 days.

(21) Appl. No.: 18/386,978

(22) Filed: Nov. 3, 2023

(65) Prior Publication Data

US 2024/0280271 A1 Aug. 22, 2024

(30) Foreign Application Priority Data

Feb. 16, 2023 (CN) ..... 202320288337.1

(51) Int. Cl.
*F24C 15/02* (2006.01)

(52) U.S. Cl.
CPC ..... *F24C 15/024* (2013.01)

(58) Field of Classification Search
CPC ..... F24C 15/024
USPC ..... 126/19 R
See application file for complete search history.

(56) References Cited

U.S. PATENT DOCUMENTS

2014/0304944 A1* 10/2014 Carr ..... A47L 15/4257 16/110.1
2018/0245797 A1* 8/2018 Johnson ..... F24C 15/006
2021/0207812 A1* 7/2021 Bhogal ..... F24C 15/006

FOREIGN PATENT DOCUMENTS

DE 102008054593 B4 * 4/2011 ..... F24C 7/082
WO WO-2010125786 A1 * 11/2010 ..... H05B 6/6435

OTHER PUBLICATIONS

Sano For Ref Translation Nov. 4, 2010.*
Sachon For Ref Translation Apr. 14, 2011.*

* cited by examiner

*Primary Examiner* — Avinash A Savani
(74) *Attorney, Agent, or Firm* — Trojan Law Offices, P.C.

(57) ABSTRACT

The present application discloses a door assembly for a cooking apparatus, which belongs to the technical field of kitchen appliances. The door assembly comprises: a door body located in housing of the cooking apparatus and movable to allow access to a cooking chamber of the cooking apparatus; a controller fixed on one side of the door body away from said housing; a handle with two ends fixed in the controller and said door body such that the handle is used to open or close the door assembly. This arrangement has the following advantages: the controller does not occupy any space in the cooking chamber space, simplifies the cook apparatus structure, reduces the number of parts, and lowers the product cost. Additionally, the controller isolated from the temperature of the cooking chamber in the housing to prevent future damage.

17 Claims, 4 Drawing Sheets

DOOR ASSEMBLY FOR A COOKING APPARATUS

CROSS-REFERENCE TO RELATED APPLICATIONS

This application claims priority to and benefit of the earlier Chinese Patent Application No. CN202320288337.1 filed on Feb. 2, 2023, the content of which is incorporated herein by reference in its entirety.

TECHNICAL FIELD

The present application belongs to the technical field of kitchen appliances, particularly door assemblies for a cooking apparatus.

BACKGROUND OF THE INVENTION

Cooking box apparatuses in the prior art typically a housing that isolates the cooking chamber from the outside, and the cooking components within the cooking chamber are controlled by a control panel or control buttons. The control panel or control buttons of the oven on the market are typically mounted on the oven housing. The control components are usually independent components, which take up a large amount of space, thereby reducing volume of the cooking chamber. Additionally, the control components require heat dissipation or significant insulation to protect the components from the relatively high temperature of the cooking chamber.

SUMMARY OF THE INVENTION

The purpose of the present application is to address at least one of the technical problems present in the prior art. To this end, the present application proposes a door assembly for a cooking apparatus, such as a cooking box apparatus. A controller for the cooking apparatus does not occupy the cooking chamber space and simplifies the product structure. At the same time, the controller is not easily affected by temperature of the oven chamber in the housing and results in a safter overall product.

In the first aspect, the present application provides a door assembly for cooking box apparatus, and the door assembly comprises: a door body located in housing of the cooking apparatus and is movable to allow access to a cooking chamber of the cooking apparatus; a controller affixed on one side of the door body away from the housing; and a handle with two ends affixed on the controller and the door body. The handle allows the door body to be opened or closed to allow access to the cooking chamber of the cooking apparatus.

By arranging the controller of the door assembly on the outside side of the door body and as a base to affix the handle, the door assembly based on the present application does not occupy the cooking chamber space. As a result, the effective space of the cooking chamber is increased, the product structure of the cooking apparatus is simplified, the number of parts is reduced, and the product cost is lowered. Additionally, the controller is safer and less prone to damage because it is not easily affected by the temperature of the cooking chamber in the housing.

According to one example of the present application, the door assembly further comprises: a handle base, the handle base located in the door body, the first end of the handle is connected to the handle base, the second end of the handle is connected to the controller.

According to one example of the present application, the controller is provided with a first retainer protrusion, the handle base is provided with a second retainer protrusion, the handle comprises a hollow round tube, and two ends of the round tube are respectively nested at the first retainer protrusion and the second retainer protrusion.

According to one example of the present application, the controller is provided with an operating surface, and the operating surface faces upwards when the door assembly is closed.

According to one example of the present application, the bottom of the door body is rotationally connected with the housing, and the controller is arranged on the outer top of the door body.

According to one example of the present application, the minimum included angle between the plane where the operating surface is located and the plane where the door body is located is a, where a>60°.

According to one example of the present application, the included angle, a<90°.

According to one example of the present application, the controller is provided with at least several heat dissipation structures.

According to one example of the present application, the controller comprises: a box body, the box body having openings; a fixing plate, the fixing plate located in the box body; a circuit board, the circuit board arranged on the fixing board, with openings exposing the circuit board; a screen-printed surface, the screen-printed surface affixed on the box body to cover the circuit board.

In the second aspect, the present application provides a cooking box apparatus, comprising a housing and a door assembly according to any of the examples described above, with the housing forming a cooking chamber; the door assembly is located in the housing, and the door assembly is suitable for opening or closing the cooking chamber.

The cooking box apparatus based on the present application, by arranging the controller on the outside side of the door, and as a base to bear the handle, does not occupy the cooking chamber space, increases effective space of the cooking chamber, simplifies the product structure, reduces the number of parts, and lowers the product cost. At the same time, the controller is not easily affected by the temperature of the cooking chamber in the housing, and the controller is safer.

Additional aspects and advantages of the present application will be given in part in the following description, which will become apparent from the following description, or learned through practice of the present application.

BRIEF DESCRIPTION OF DRAWINGS

The above and/or additional aspects and advantages of the present application will become apparent and readily understood from description of examples in connection with the following drawings, wherein.

DETAILED DESCRIPTION OF THE INVENTION

Examples of the present application are described in detail below, examples of which are shown in the attached drawings, wherein the same or similar numerals throughout represent the same or similar elements or elements having the same or similar functions. The examples described below with reference to the attached drawings are exemplary, and are for the purpose of interpreting the present application only, which should not be construed as limiting the present application.

Unless otherwise specified, the left and right directions in this application are horizontal, i.e., Y direction; the upper and lower directions are vertical, i.e., Z direction.

A door assembly for a cooking box apparatus according to examples of the present application is described below with reference to FIGS. 1-5.

Figure 1:
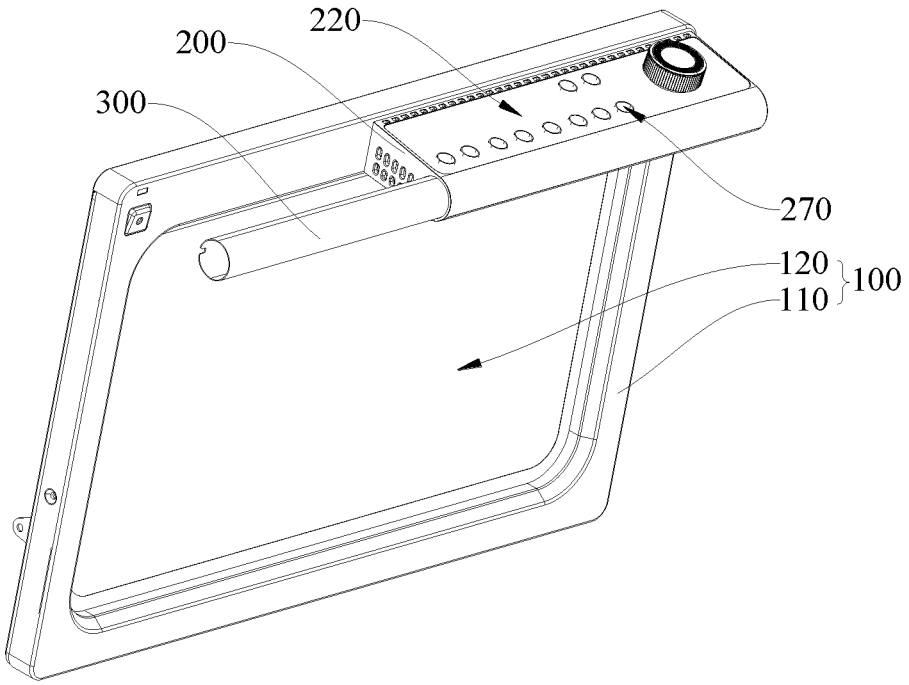
FIG. 1 is the first structural schematic diagram of the door assembly provided by examples of the present application.
Figure 5:
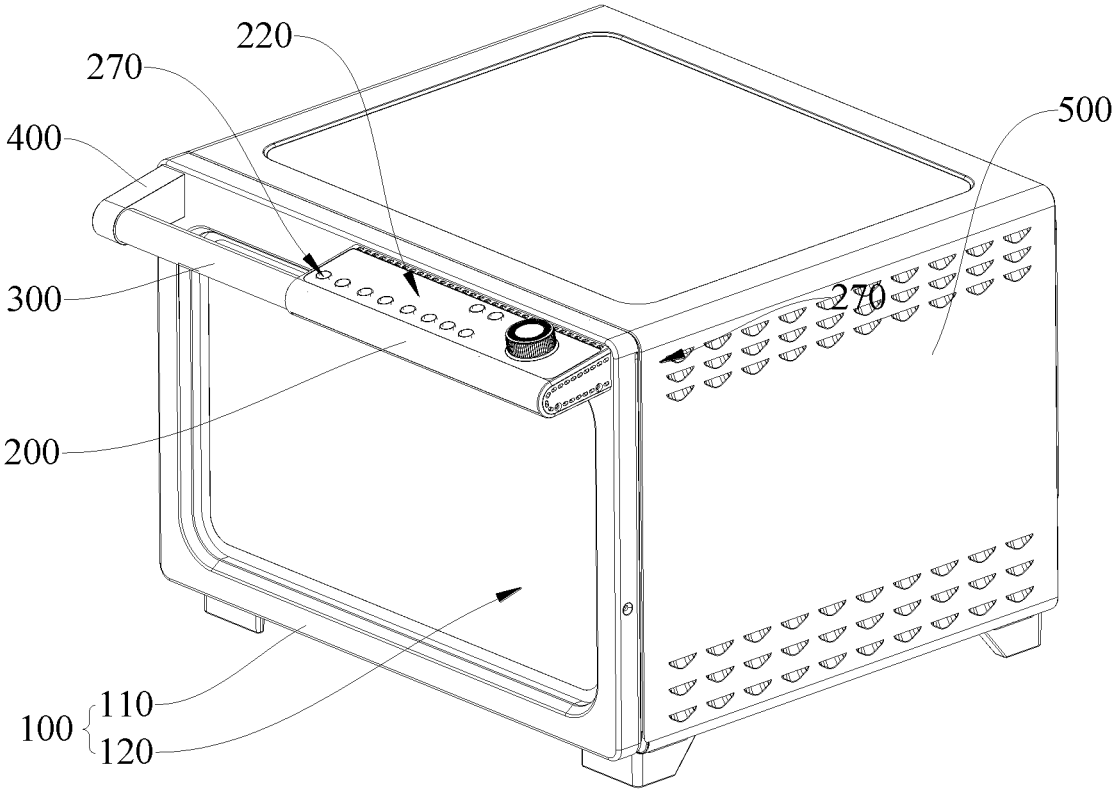
FIG. 5 is a structural schematic diagram of the cooking apparatus provided by examples of the present application.

As shown in FIGS. 1 and 5, one example of the present application provides a door assembly for a cooking apparatus.

In the present embodiment, the door assembly comprises a door body 100, a controller 200, and a handle 300; a movable door body 100 located in the housing 500 of a cooking apparatus. The controller 200 is fixed on one side of the door body 100 away from the housing 500 and At least one ends of the handle 300 are affixed to the controller 200. The handle 300 operates the door body 100 to open or close the cooking chamber of the cooking apparatus.

In some examples, the cooking apparatus may be an oven or microwave oven or a similar cooking appliance. The cooking apparatus may comprise a housing and cooking components, the housing 500 forms a cooking chamber, the cooking components are located inside the housing, the cooking components may heat a cooking chamber of the cooking apparatus. The housing 500 is provided with an opening connecting the cooking chamber at which the door body 100 is located and the door body 100 can seal such opening. Of course, the cooking apparatuses can be other types of appliances, which is not limited by this implementation.

In the present embodiment, the controller 200 comprises a housing and an integrated control system inside the housing connected to the cooking components for controlling the start, stop, or adjustment of operating parameters of the cooking components. The specific composition of the control system can be determined according to the type of cooking components. The cooking components can be heating tubes or microwave heating components, or similar means for heating the cooking chamber as known in the prior art.

In some examples, one side of the door body 100 may be rotationally connected with the housing 500 along which the door body 100. The position of the door body 100 may be adjusted to suit the needs of the cooking apparatus. In general, the door body 100 can be repositioned relative to the housing 500 to switch between a closed state and the open state for the cooking chamber within the housing 500. When the door body 100 is in the closed state, the door body 100 closes the opening on the housing, isolating the cooking chamber from the exterior and closing the housing 500. When the door body 100 is in the open state, the door body 100 opens the opening on the housing, allowing access to the cooking chamber from the exterior, then the housing 500 is opened.

It is to be noted that the controller 200 can be secured on the opposite side of the side of the rotational connection with the housing 500, thereby allowing for ease of operation in opening and/or closing the door body 100. For example, the left side of the door body 100 is rotationally connected with the housing 500, then the controller 200 is fixed to the right side of the door body 100.

It can be understood that the handle 300 is fixed on the outer surface of the housing of the controller 200, and the housing of the controller 200 is fixed on the door body 100, so when the handle 300 is subjected to pulling force or pushing force, such pulling force or pushing force will be transferred to the door body 100, thereby driving action of the door body 100. For example, the door body 100 can be opened by applying outward pulling force to the handle 300 when the door body 100 is in the closed state; the door body 100 can be closed by applying inward pushing force to the handle 300 when the door body 100 is in the open state. Wherein, outward refers to a direction from inside to outside of the housing 500, while inward refers to a direction from outside to inside of the housing 500.

By arranging the controller 200 on the outside side of the door body 100, and as a base to bear the handle 300, the door assembly does not occupy the cooking chamber space, increases effective space of the cooking chamber, simplifies the product structure, reduces the number of parts, and lowers the product cost. At the same time, the controller 200 is not easily affected by the temperature of the cooking chamber in the housing 500, and the controller 200 is safer.

Figure 2:
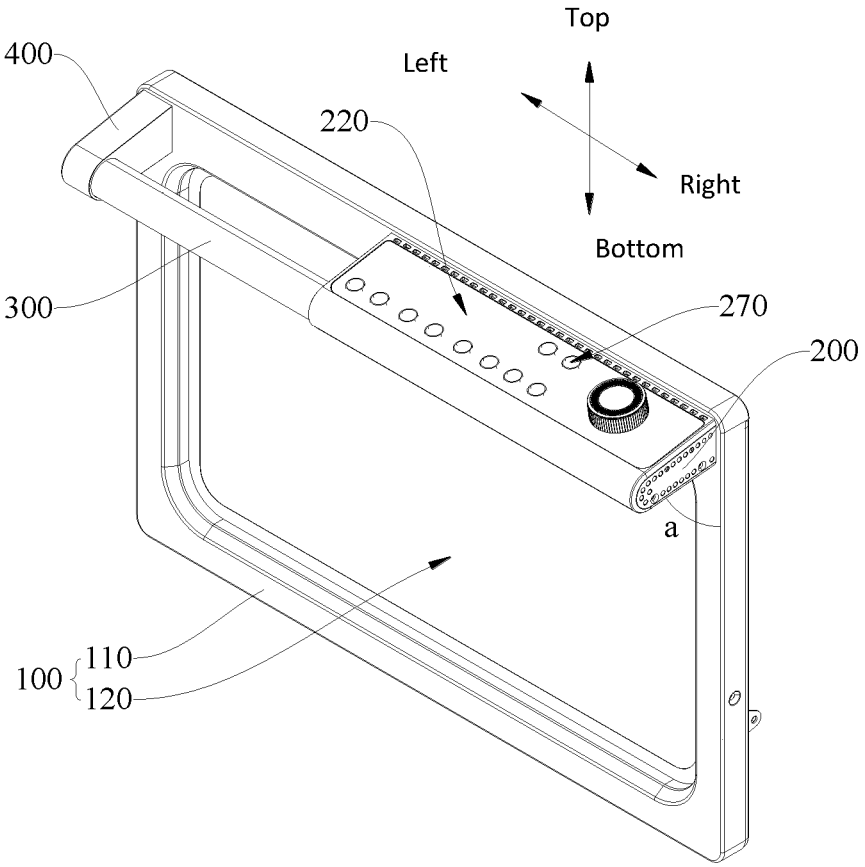
FIG. 2 is the second structural schematic diagram of the door assembly provided by examples of the present application.

As shown in FIG. 2, in some examples of the present application, the door assembly may further comprise a handle base 400 located in the door body 100; the first end of the handle 300 is connected with the handle base 400, and the second end of the handle 300 is connected with the controller 200.

In some examples, the handle base 400 and the controller 200 can be bolted to the door body 100, and the two are aligned in horizontal direction or vertical manner. Accordingly, the handle 300 is set between the handle base 400 and the controller 200, which is arranged in the same horizontal direction or vertical manner. The handle 300 can be respectively fixed on two opposite sides of the handle base 400 and the controller 200, and its fixation method can be threaded connection or flange connection, etc.

It can be understood that the handle base 400 and the controller 200 form a connection seat connected with the door body 100 at both ends of the handle 300, and the force received by the handle 300 can be transferred to the door body 100 along the handle base 400 and the controller 200 on both sides, thereby causing the door body 100 to be more uniformly stressed and easy to operate.

Figure 3:
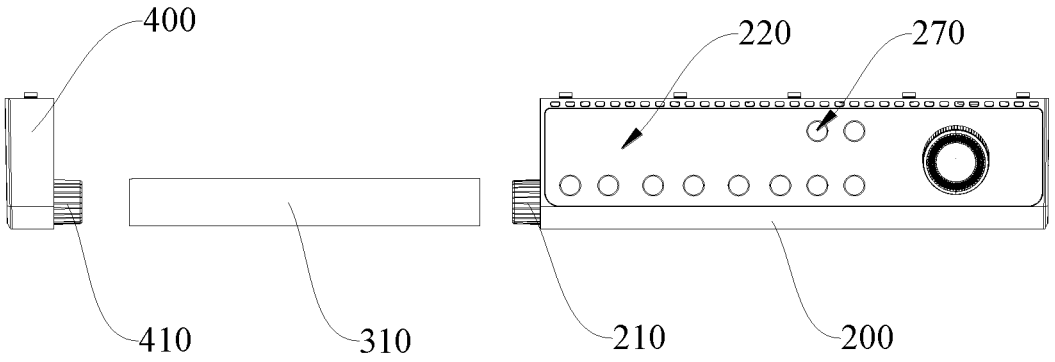
FIG. 3 is a breakdown schematic diagram of the handle provided by examples of the present application.

As shown in FIG. 3, in some examples of the present application, the controller 200 is set with the first retainer protrusion 210, the handle base 400 is set with the second retainer protrusion 410, the handle 300 comprises a hollow round tube 310, and two ends of the round tube 310 are respectively nested at the first retainer protrusion 210 and the second retainer protrusion 410.

In the present embodiment, the first retainer protrusion 210 is set on the side of the controller 200 towards the handle base 400, and the second retainer protrusion 410 is set on the side of the handle base 400 towards the controller 200. The first retainer protrusion 210 and the second retainer protrusion 410 can be in cylindrical state, and their outer diameter must be able to be inserted into the round tube 310.

In some examples, the round tube 310 can act as the body of the handle 300, and two ends of the round tube 310 are in active connection with the first retainer protrusion 210 and the second retainer protrusion 410 to facilitate assembly. The first retainer protrusion 210 and the second retainer protrusion 410 are fitted with the round tube 310 via a friction fit or other method of attachment.

As an example, the assembly process can be: the first retainer protrusion 210 and the second retainer protrusion 410 are respectively inserted into two ends of the round tube 310, to connect the round tube 310 with the controller 200 and the handle base 400; then the controller 200 and the handle base 400 are secured on the door body 100.

In some examples of the present application, the controller 200 is set with operating surface 220, the operating face 220 is arranged upward so it can be seen by the user.

It should be noted that the operating surface 220 refers to the surface of one side provided with the interactive components on the housing of the controller 200. The interactive components can include knobs, buttons, a touch screen, or a display screen, or the like as known in the art. The viewing angle of the user using the product is typically top down, thus the operating surface 220 is arranged upwards for easy viewing and operation by the user.

In some examples of the present application, the bottom of the door body 100 is rotationally connected with the housing 500, and the controller 200 is set on the outer top of the door body 100.

In this implementation, the controller 200 is located on top of the door body 100, and the operating surface 220 on the controller 200 is arranged upwards, fitting the user's perspective, for easy operation.

In some examples, the bottom of the door body 100 can be set with a spool connecting the housing of the housing 500. When the door body 100 is opening or closing, the door body 100 rotates around such spool.

In some examples of the present application, the minimum included angle between the plane where the operating surface is located and the plane where the door body is located is angle a, which is >60°.

Taking vertical placement of the door body as an example, the plane of the door body is the vertical plane, and the plane of the operating surface can be parallel to the direction where the controller is laid out. The minimum angle, a, is the angle between the controller and the door body when the operating surface is tilted downwardly in a direction away from the housing 500. The minimum angle, a, is the angle between the controller and the door body supplemented along the vertical plane, when the operating surface is tilted upwardly in a direction away from the housing 500. By arranging the angle, a>60°, the operating surface visually facilitates presentation of the panel to the user and eases control.

In some examples of the present application, the angle, a, is <90°.

In this implementation, the tilting operating plane arrangement is more convenient to view and operate. Further, the operating face can be tilted downwardly in a direction away from the housing 500.

In some examples, the axis of the handle 300 is arranged horizontally, and the handle 300 is connected with sidewall of the controller 200.

In some examples, the body of the handle 300 is the round tube 310, the axis of the round tube 310 is arranged horizontally. When used by a user, the tube 310 can be gripped horizontally. The round tube 310 is arranged in the vertical plane of the door body 100, and does not easily interfere with other sites of the housing 500.

In some examples, the handle base 400 is also fixed to the top of the door body 100, and is in horizontal alignment with the controller 200. For example, the controller 200 is located on the right side, the handle base 400 can be located on the left side, the right side of the round tube 310 is nested at the first retainer protrusion 410 on the controller 200, and the left side of the round tube 310 is nest at the second retainer protrusion 420 on the handle base 400. Alternatively, the controller 200 is located on the left side, the handle base 400 can be located on the right side, the left side of the round tube 310 is nested at the first retainer protrusion 410 on the controller 200, and the right side of the round tube 310 is nest at the second retainer protrusion 420 on the handle base 400.

In some examples of the present application, the door body 100 can include the bezel 110 and glass, the bezel 110 is connected with the housing 500, and the middle of the bezel 110 is set with the hollow region 120; the glass is connected with the bezel 110 and is set in the hollow region 120.

In some examples, the bezel 110 can be rectangular, the upper bezel of the bezel 110 may serve as the top of the door body 100, and the controller 200 and/or the handle base 400 can be fixed on the upper bezel. The lower bezel of the bezel 110 can act as the bottom of the door body 100, and the lower bezel can be in rotational connection with the housing of the housing 500.

In some examples, the glass can be transparent glass. The surroundings of the transparent glass can be connected to the bezel 110 by adhesive. The transparent glass can facilitate the user view the interior of the housing 500, improving usability.

In some examples of the present application, the controller 200 is set with at least several heat dissipation structures 270.

In some examples, the heat dissipation structures 270 can be arranged on the operating surface, and the heat dissipation structures 270 are tunnels from interior to the exterior of the controller 200, thereby providing heat dissipation and avoiding heat accumulation inside the controller 200.

Figure 4:
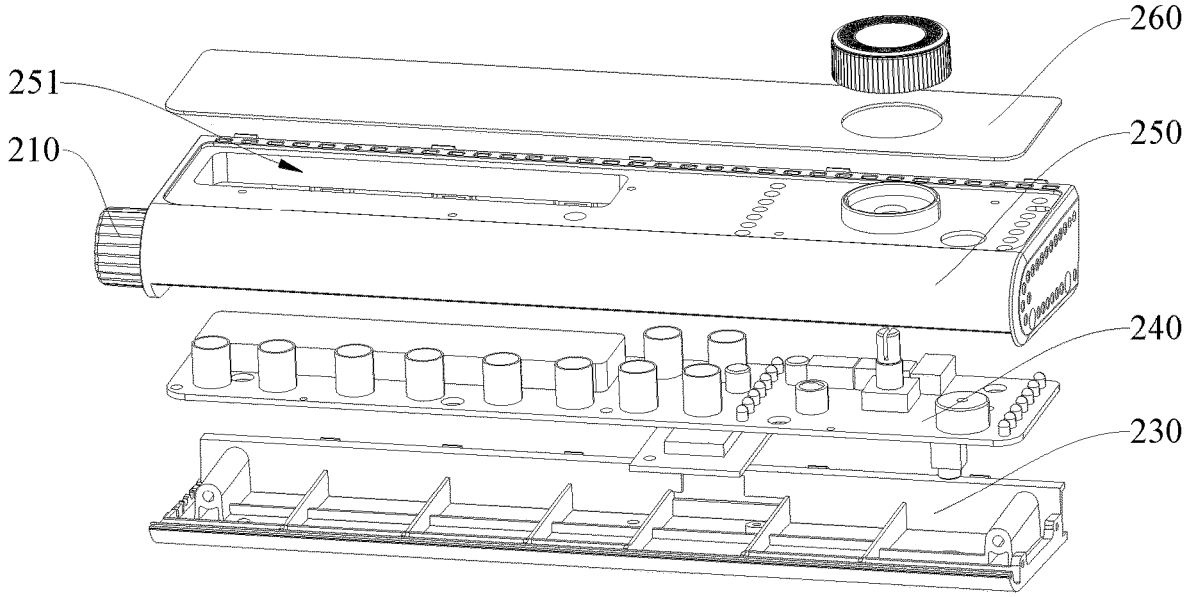
FIG. 4 is a breakdown schematic diagram of the controller provided by examples of the present application.

As shown in FIG. 4, in some examples of the present application, the controller 200 can include the box seat 230, the circuit board 240, the box lid 250, and the screen-printed surface 260; the circuit board 240 is set on the box seat 230; the box lid 250 is fit in with the box seat 230, the box lid 250 is set with the opening 251, and the opening 251 exposes the circuit board 240; the screen-printed surface 260 is arranged on the box lid 250 to cover the circuit board 240.

In the present implement, the housing of the controller 200 adopts the split design, dividing into the box seat 230 and the box lid 250, which is conducive to mold release during mold injection and good control of appearance defects.

In some examples, the first retainer protrusion 210 can be set on the side of the box lid 250, and the handle 300 is connected with the first retainer protrusion 210. Alternatively, the handle 300 can also be bolted or the like to the side of the box lid 250.

It is to be noted that the circuit board 240 is printed with control circuitry that can connect with cooking components within the housing 500 to control the start, stop, or adjustment of the operating parameters of the cooking components, the specific structure of the control circuitry corresponds to the type of cooking components, and corresponding control circuitry includes technology known in the art of control interfaces.

As an example, the assembly process of the controller 200 can be: the circuit board 240 is first secured to the box base 230; the box lid 250 is then secured to the box base 230; finally, the screen-printed surface 260 is stuck on the opening 251 of the box lid 250. The above-mentioned method of securement can be bolted, and the controller 200 can also be bolted to the door body 100 after assembly is completed.

In some examples, the circuit board 240 is arranged with interactive components, such as knobs, buttons, etc. The screen-printed surface 260 is arranged with openings at sites corresponding to the interactive components to expose the interactive components for ease of operation.

In some examples of the present application, the controller can further comprise a box body, a fixing plate, a circuit board 240, and a screen-printed surface 260, the box body being provided with an opening 251; the fixing plate is set on the box body; the circuit board 240 is set on the fixing plate, and the opening 251 exposes the circuit board; the screen-printed surface 260 is set on the box body to cover the circuit board 240.

In the present implementation, the box body is designed integrally to serve as housing of the controller 200. The integrated box body provides better sealing and stability. The fixing plate is primarily used to bear the circuit board 240 to facilitate securing the circuit board 240 inside the box body. Relevant structures of the circuit board 240 and the screen-printed surface 260 can refer to the above examples.

As an example, the assembly process of the controller 200 can be: The circuit board 240 is first fixed to the fixing plate; the fixing plate is then fixed to the box body; finally, the screen-printed surface 260 is stuck on the opening 251 of the box lid 250. The above-mentioned method of securement can be bolted, and the controller 200 can also be bolted to the door body 100 after assembly is completed.

In the second aspect, the present application provides a cooking box apparatus, comprising a housing and a door assembly according to any of the examples described above, with the housing 500 forming a cooking chamber; the door assembly is located in the housing 500, and the door assembly is suitable for opening or closing the cooking chamber. Specific structure of the door assembly can refer to the aforementioned examples, and it is not described again in this implementation.

The cooking box apparatus based on the present application, by arranging the controller 200 on the outside side of the door body 100, and as a base to bear the handle 300, does not occupy the cooking chamber space, increases effective space of the cooking chamber, simplifies the product structure, reduces the number of parts, and lowers the product cost; at the same time, the controller 200 is not easily affected by the temperature of the cooking chamber in the housing, and the controller 200 is safer.

The terms "the first," "the second," and the like in the specification and claims of the present application are used to distinguish similar objects, and are not used to describe a particular order or sequential order. It should be understood that the data used in this manner can be interchanged where appropriate, so that the examples of the present application can be implemented in a sequence other than those illustrated or described herein, and that "the first", "the second", and the like distinguishing objects are generally of the same category and do not limit the number of objects, for example, the first object(s) may be one or several. Furthermore, the "and/or" in the specification and claims refers to at least one of the associated objects, and the character, "/", generally indicates the relationship between the contextual objects as "or".

In the descriptions of this application, it is to be understood that the orientation or location relationships indicated by the terms "center", "vertical", "horizontal", "upper", "lower", "front", "back", "left", "right", "vertical", "horizontal", "top", "bottom", "inner", "outer", etc. are based on the orientation or location relationships shown in the drawings. They are merely for the purpose of describing this application and simplifying the descriptions and are not intended to indicate or imply that the apparatus or element referred to must have a particular orientation or be constructed and operated in a particular orientation, and thus cannot be construed as limitations to this application.

In the description of the present application, the first feature "on" or "under" the second feature, can comprise direct contact between the first and second features, or further comprise indirect contact between the first and second features but through additional features therebetween.

In the description of the present application, the first feature "on," "above," and "upper," the second feature, comprises the first feature directly above and obliquely above the second feature, or simply indicates that the level of the first feature is higher than that of the second feature.

In the description of this specification, the description by reference terms "one example", "some examples", "schematic examples", "examples", "specific examples", or "some examples", etc. means that specific features, structures, materials, or characteristics described in connection with such examples or implementations are included in at least one example or implementation of the present application. In the present specification, indicative representations of the above-described terms do not necessarily refer to the identical example for example. Moreover, the specific features, structures, materials, or characteristics described may be combined in a suitable manner in any one or more examples or examples.

Although examples of the present application have been shown and described, those of ordinary skill in the art can understand that: various changes, modifications, substitutions and transformations can be made to these examples without departing from the principles and purposes of the present application; the scope of this application is defined by the claims and their equivalents.

DRAWING REFERENCE SIGNS door body 100, bezel 110, hollow region 120;
controller 200, first retainer protrusion 210, operating surface 220, box seat 230, circuit board 240, box lid 250, opening 251, screen-printed surface 260, heat dissipation structure 270;
handle 300, round tube 310;
handle base 400, second retainer protrusion 410;
housing 500.

The invention claimed is:

1. A door assembly for a cooking apparatus, the door assembly comprising:

a door body, said door body movable relative to a housing of said cooking apparatus with a cooking chamber;

a controller, said controller being fixed on an outer side of said door body away from said housing, said outer side extending between a first edge of said door body and a second edge of said door body, said door body being rotatably coupled to said housing;

said controller having an elongated body with a first end and a second end, said first end being positioned adjacent to said first edge of said door body;

a handle base fixed on said outer side adjacent to said second edge;

an elongated handle extending between and connecting said handle base and said second end of said elongated body of said controller;

wherein said elongated handle is spaced apart from said outer side to form an enclosed hand grip opening defined by said outer side, said handle base, said elongated handle, and said second end of said elongated body of said controller;

whereby a hand can be inserted through said hand grip opening to grasp said elongated handle and rotatably move said door body.

2. The said door assembly according to claim 1, wherein said elongated handle is a round tube.

3. The door assembly according to claim 1, wherein said elongated handle is connected to a first retainer protrusion on said controller and a second retainer protrusion on said handle base.

4. The door assembly according to claim 1, wherein said controller has an operating surface.

5. The door assembly according to claim 1, wherein said controller is arranged on a top of said outer side of said door body.

6. The door assembly according to claim 4, wherein said operating surface is arranged upward so it can be seen by a user.

7. The door assembly according to claim 6, wherein the minimum angle between the plane of said operating surface and the plane of said door body is greater than 60°.

8. The door assembly according to claim 7, wherein said angle between the plane of said operating surface and the plane of door body is less than 90°.

9. The door assembly according to claim 7, wherein said controller is provided with a plurality of heat dissipation structures.

10. The door assembly according to claim 9, wherein said plurality of heat dissipation structures comprise of tunnels between the interior to the exterior of the operating surface.

11. The door assembly according to claim 1, wherein the handle base is fixed to a top of the door body, and is in horizontal alignment with the controller.

12. The door assembly according to claim 1, wherein the door body includes a bezel, the bezel is connected with the housing.

13. The door assembly according to claim 12, wherein the bezel can be rectangular and the upper portion of the bezel is the top of the door body.

14. The door assembly according to claim 13, wherein the controller is fixed on the upper bezel.

15. The door assembly according to claim 13, wherein the handle base is fixed on the upper bezel.

16. The door assembly according to claim 1, wherein the door assembly has an open position to provide access to said cooking chamber.

17. The door assembly according to claim 1, wherein the door assembly has a closed position to prevent access to said cooking chamber.

* * * * *